United States Patent [19]

Madsen

[11] 4,355,677

[45] Oct. 26, 1982

[54] DRAPERY HANGER AND MANIPULATOR

[76] Inventor: Harold L. Madsen, 14615 Clark St., Dolton, Ill. 60419

[21] Appl. No.: 293,652

[22] Filed: Aug. 17, 1981

[51] Int. Cl.[3] ..... A47H 1/00

[52] U.S. Cl. ..... 160/126; 160/330; 160/345

[58] Field of Search ..... 160/123-126, 160/330, 345, 346

[56] References Cited

U.S. PATENT DOCUMENTS

| | | | |
|---|---|---|---|
| 1,494,428 | 5/1924 | Kirsch . | |
| 1,662,928 | 3/1928 | Kirsch . | |
| 1,746,143 | 2/1930 | Callahan . | |
| 1,756,365 | 4/1930 | Kirsch . | |
| 2,636,556 | 4/1953 | Light et al. | 160/11 |
| 2,653,344 | 9/1953 | Graber | 16/94 |
| 3,130,775 | 4/1964 | Walker | 160/172 |
| 3,311,158 | 3/1967 | Mason et al. | 160/126 |
| 3,361,190 | 1/1968 | Snyder | 160/330 |
| 3,424,225 | 1/1969 | Magnusson | 160/345 |
| 3,430,678 | 3/1969 | Steck et al. | 160/346 |
| 3,513,900 | 5/1970 | Ronfola | 160/126 |
| 3,667,531 | 6/1972 | Wilkins | 160/345 |
| 3,844,330 | 10/1974 | Hyman | 160/166 A |
| 3,982,581 | 9/1976 | Madsen | 160/340 |
| 4,112,995 | 9/1978 | Pasinski | 160/126 |
| 4,240,489 | 12/1980 | Madsen | 160/126 |

*Primary Examiner*—Peter M. Caun

*Attorney, Agent, or Firm*—Evan D. Roberts

[57] ABSTRACT

An improved drapery hanger and manipulator is disclosed herein having drapery panels or segments suspended on groups of drapery hook hangers and a series of carriers slidably actuatable along a traverse track bridge with inter-working structures and mechanisms driven and operated by a linear drive means for independently moving and positioning the carriers and associated panels or segments.

11 Claims, 25 Drawing Figures

DRAPERY HANGER AND MANIPULATOR

SUMMARY OF THE INVENTION

This invention relates to an improved drapery hanger and manipulator for supportably hanging and selectively manipulating drapery curtains of a series of drapery curtain panels by means of groups of drapery hook hangers and drapery carriers slidably mounted on a traverse track bridge and selectively driven and otherwise manipulated to individually spread or collapse the respective curtain panels over the area to be covered with improved manipulating means whereby the individual panels can be made to individually completely cover a given area, to be collapsed within said area to allow light to pass therebetween, and to be variably positioned over said area and moved along the overall area to a selected position therealong.

In the known types of drapery or curtain supporting devices, it is a common facility thereof to provide some means by which draperies or curtains can be manipulated from side to side or from top to bottom or even rotated in place over a given area to be covered by the drapes or curtains. To accomplish this, the drapery holders in known types of devices slide or otherwise merely move the drapes or curtains to and fro by pulling on one end or the other of the drapes, or to rotate the drapes about a given position, to complete, or partially complete, the closing of the opening to be covered thereby.

It is a general primary object of the drapery hanger and manipulator of this invention to provide an improved drapery curtain hanger and manipulator which, when operated, will provide selective positioning of independent segments of drapery curtains, over or along an area to be covered thereby, and with a selective degree of extension or collapse in either direction in addition to being selectively positionable along the opening to be affected thereby.

Further, it is an object of this invention to provide an improved drapery hanger and manipulator which is selectively operated to and fro across the drapery area and yet be selectively expandable or collapsible in any position over that area by the selective bilateral operation of a single linear drive or actuating means.

Other advantages and novel aspects of this invention will become apparent from the following detailed description, in conjunction with the accompanying drawings wherein.

Figure 5:
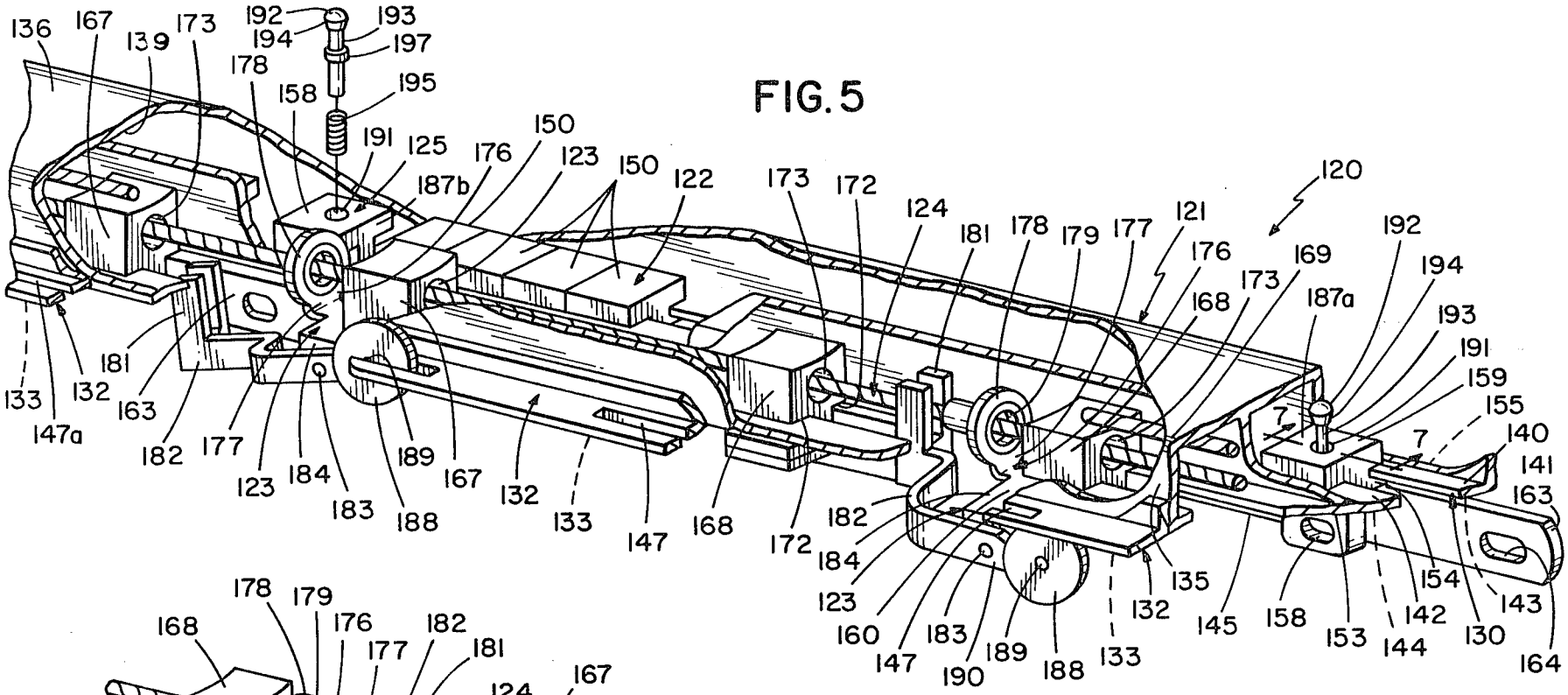
Figure 7:
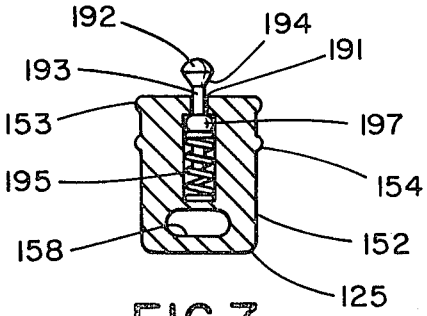
Figure 6:
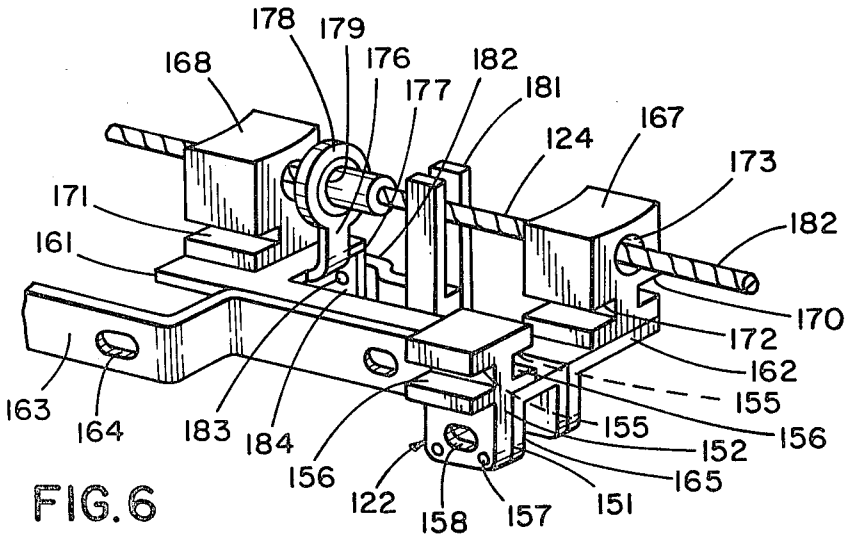

FIG. 5 is a partially cutaway partial perspective view of a traverse track bridge of a second improved embodiment of this invention showing a first and second track means positioned horizontally with respect to each other, and the structure of the traverse track bridge, cam means, drapery hook hangers, drapery carriers, linear drive means, cam follower and a frictional ball, shaft and spring retainer means, and the mechanical interrelationship of these structures;

FIG. 6 is a perspective view of the drapery carrier of the second improved embodiment of this invention showing the linear drive therethrough and a cam follower pivotally connected thereto, and the drapery carrier drivingly connected with the linear drive means for drive in either direction;

FIG. 7 is a sectional view taken along line 7—7 of FIG. 5 showing the friction spring-ball retainer means.

Figures 8, 9, 10:
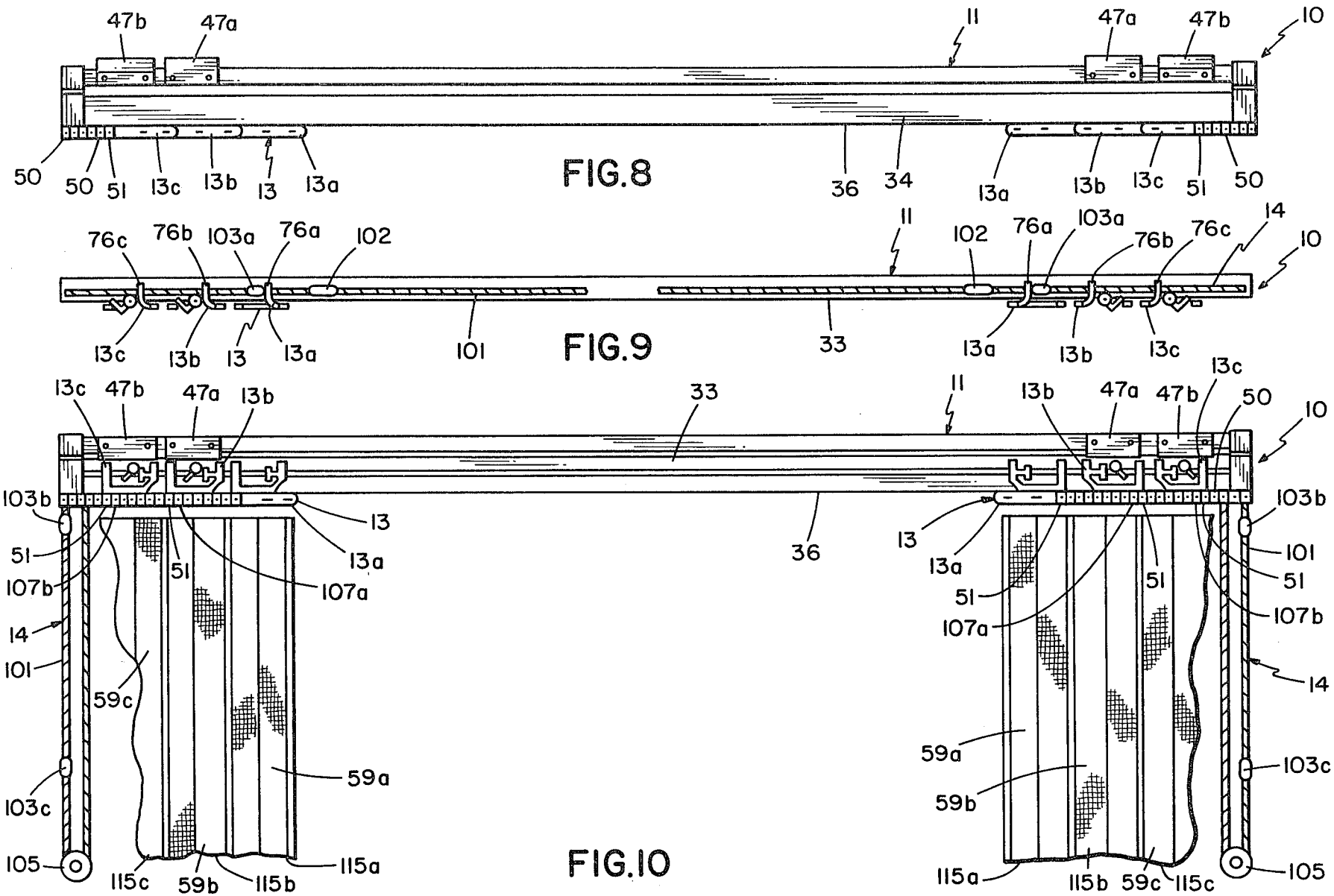

FIG. 8 is a schematic front elevation view of the drapery hanger and manipulator of the first improved embodiment of this invention showing the position of the bridge, cam trip plates, drapery carriers, and drapery hook hanger means when the drapery hanger and manipulator is in the full open position.

Figures 11, 12, 13:
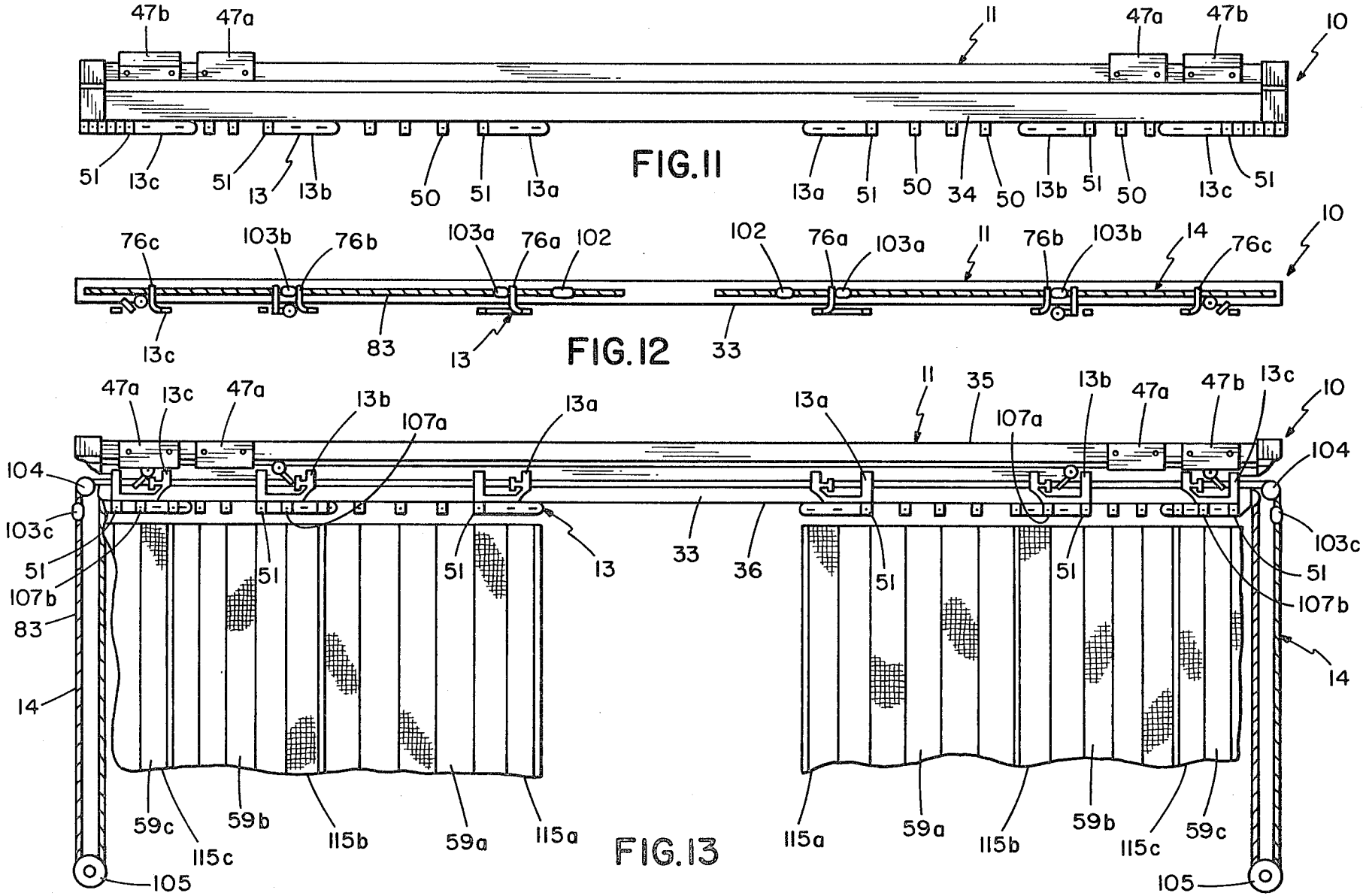
Figure 14:
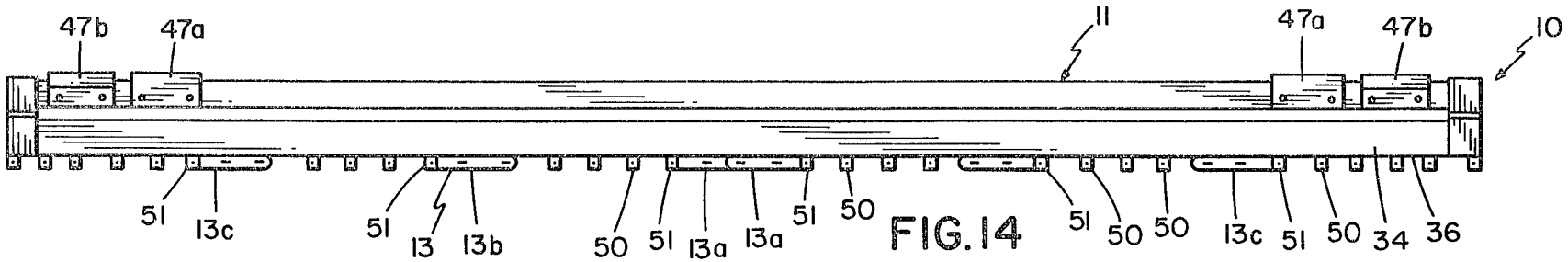
Figure 15:
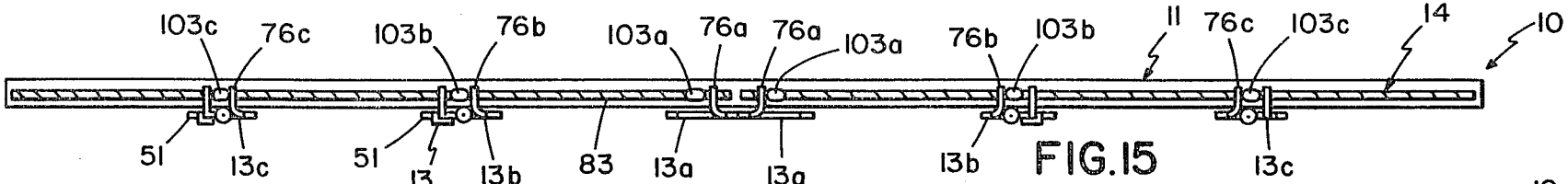
Figure 16:
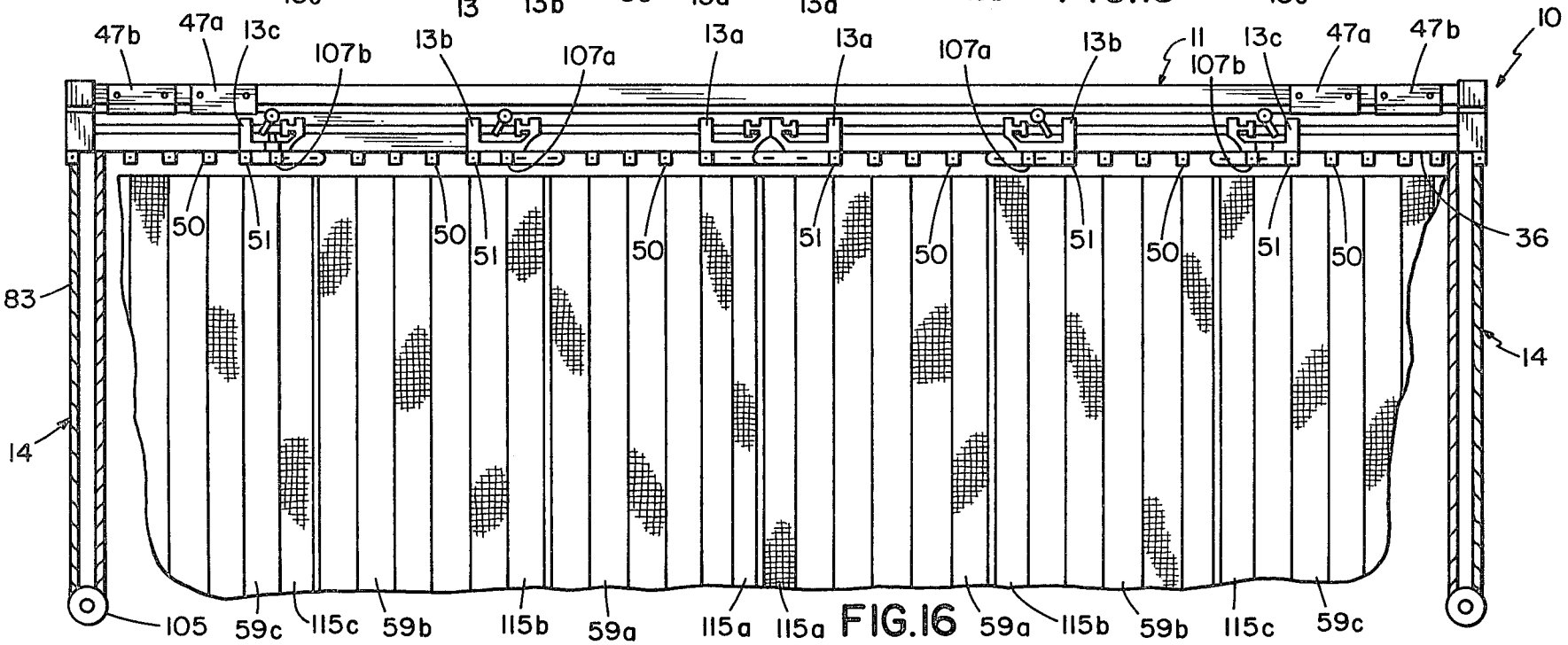
Figures 17, 18, 19:
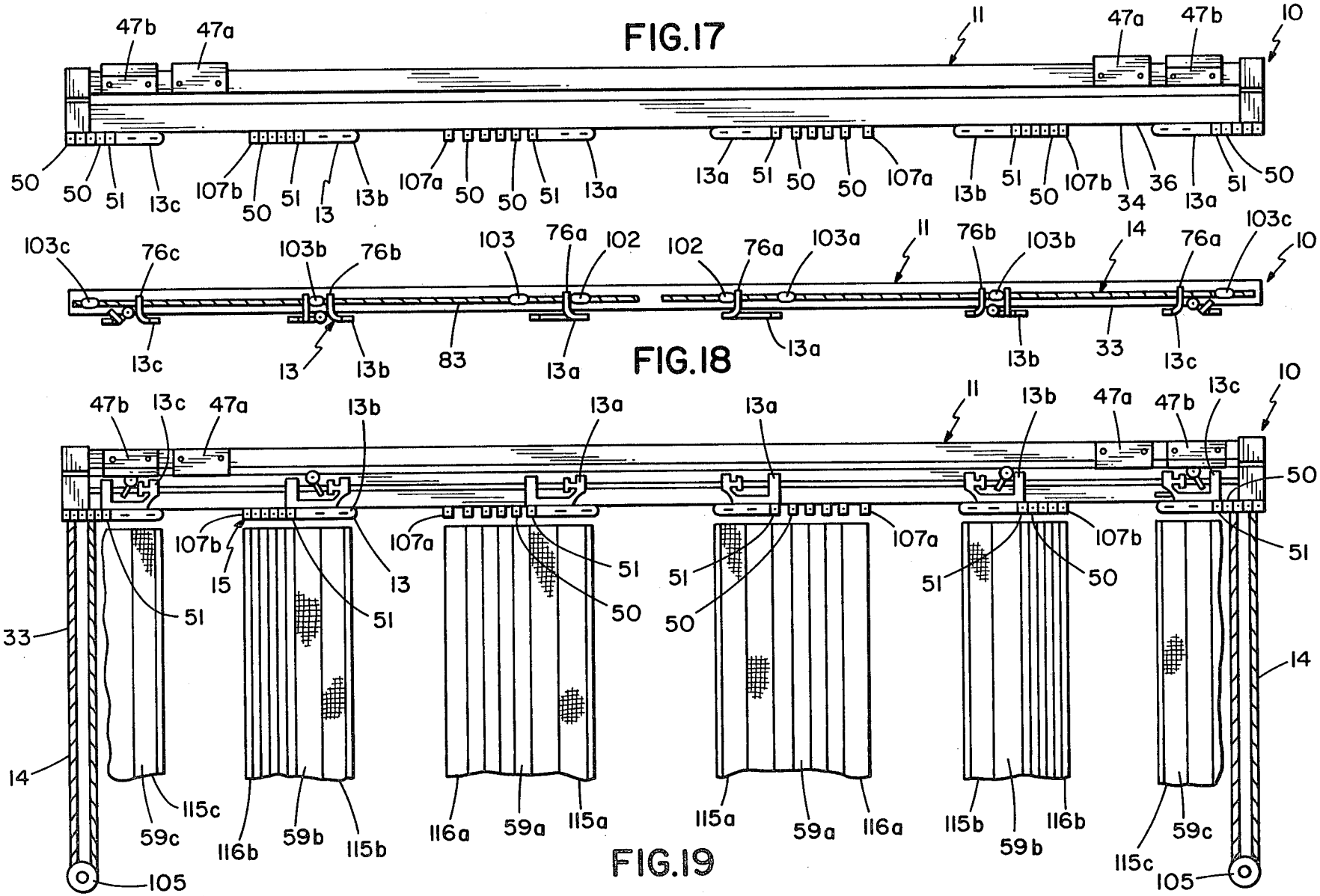
Figure 20:
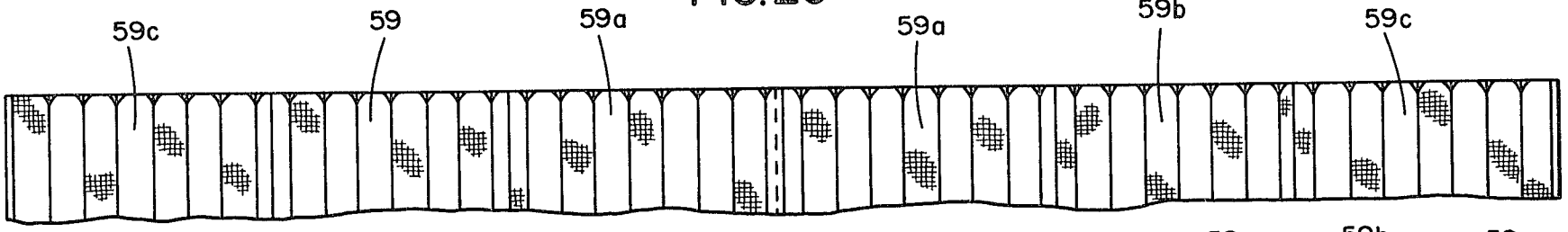
Figure 22:
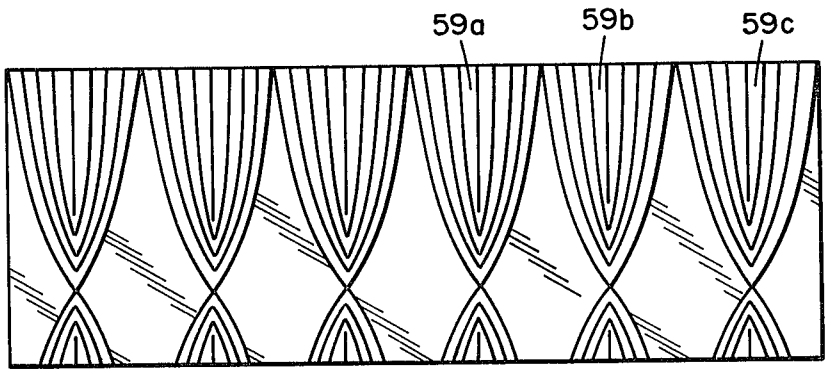
Figure 21:
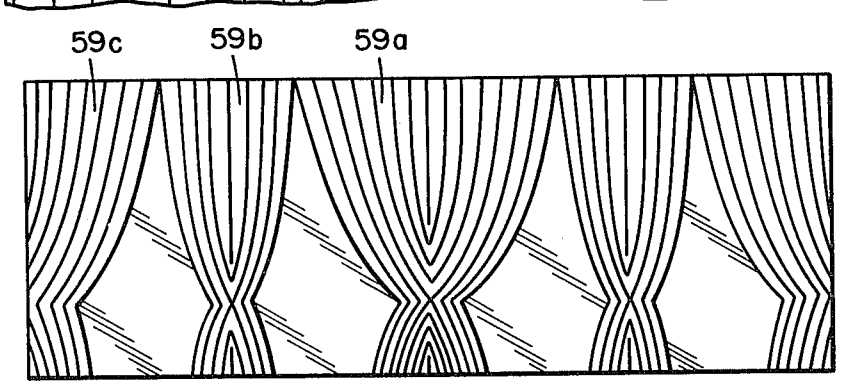
Figure 24:
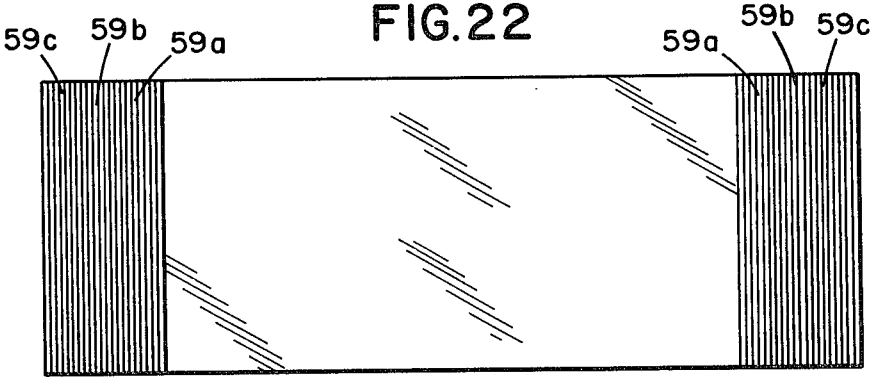
Figure 23:
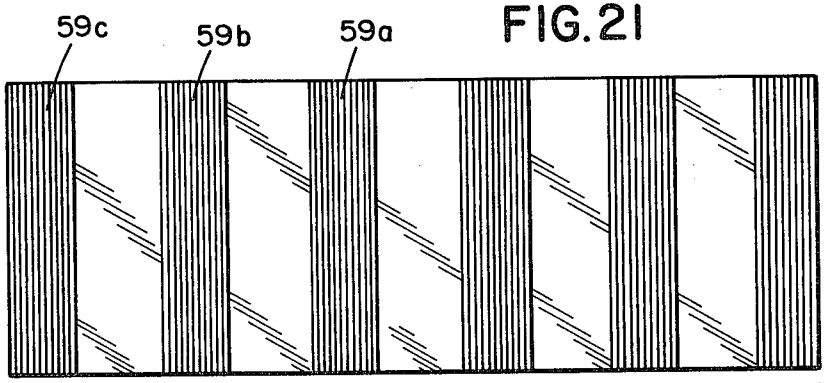

FIG. 9 is a partially sectioned schematic top view of the improved first embodiment of this invention illustrating the relative interconnection between the linear drive means and the drapery carriers when the drapery hanger and manipulator is in the full open position;

FIG. 10 is a rear schematic elevation view of the improved drapery hanger and manipulator of this invention with the traverse track bridge partially sectioned showing the position of the drapery carriers, retainers and cam means on said track when said drapery hanger and manipulator is in the full open position;

FIG. 11 is a schematic front elevation view of the drapery hanger and manipulator of the first improved embodiment of this invention showing the lead drapery carrier being actuated to an intermediate position along the traverse track bridge to provide a partially closed position of the drapery hanger and manipulator;

FIG. 12 is a partially sectioned schematic top view of the first improved embodiment of this invention illustrating the relative interconnection between the linear drive means and the drapery carriers when the drapery hanger and manipulator is in the partially closed position;

FIG. 13 is a rear schematic elevation view of the improved drapery hanger and manipulator of this invention with the traverse track bridge partially sectioned showing the position of the drapery carriers, retainers and cam means on said track when said drapery hanger and manipulator is in the partially closed position;

FIG. 14 is a schematic front elevation view of the drapery hanger and manipulator of the first improved embodiment of this invention showing the lead drapery carrier being actuated to a central overlapping position along the traverse track bridge to provide a fully closed position of the drapery hanger and manipulator;

FIG. 15 is a partially sectioned schematic top view of the first improved embodiment of this invention illustrating the relative interconnection between the linear drive means and the drapery carriers when the drapery hanger and manipulator is in the fully closed position;

FIG. 16 is a rear schematic elevation view of the drapery hanger and manipulator of this invention with the traverse track bridge partially sectioned showing the position of the drapery carriers, retainers and cam means, and drapery panels, on said track when said drapery hanger and manipulator is in the fully closed position;

FIG. 17 is a schematic front elevation view of the drapery hanger and manipulator of the first improved embodiment of this invention showing the lead and the cam follower drapery carriers being actuated from the central position along the traverse track bridge to provide a partially spaced open position of the drapery hanger and manipulator with interrelation of retainers thereto;

FIG. 18 is a partially sectioned schematic top view of the first improved embodiment of this invention illustrating the relative interconnection between the linear drive means and the drapery carriers when the drapery hanger and manipulator is being actuated from the central closed position to the partially spaced open position;

FIG. 19 is a rear schematic elevation view of the improved drapery hanger and manipulator of this invention with the traverse track bridge partially sectioned showing the position of the drapery carriers, retainers and cam means on said track when said drapery hanger and manipulator is being urged to the partially spaced open position;

FIG. 20 shows the condition of the drapes with the carrier elements in the position as shown in FIG. 15 and with the drapes in an unrestricted closed position;

FIG. 21 is a front elevation view of drapery curtains showing a drapery design which can be accomplished by tying back selected ones of said drapery curtain panels, and with the improved drapery curtain hanger and manipulator moved to the fully closed position;

FIG. 22 is a front elevation view of drapery curtains showing a drapery design which can be accomplished by tying back alternate selected ones of said drapery curtain panels, and with the improved drapery curtain hanger and manipulator moved to the fully closed position;

FIG. 23 is a front elevation view of curtains of the drapery hanger of this invention showing the semi-open and spaced apart position which may be accomplished by the improved drapery hanger and manipulator of this invention after being first closed and then partially reopened as shown in FIG. 19; and FIG. 24 is a front elevation view of curtains of the improved drapery hanger and manipulator of this invention showing the fully open position which may be accomplished by the drapery hanger and manipulator of this invention.

A first embodiment of the improved drapery hanger and manipulator of this invention is disclosed specifically in FIGS. 1–4, and generally in FIGS. 8–20, and is generally illustrated by the numeral 10. This first embodiment includes generally, a traverse track bridge 11, drapery hook hanger means 12, drapery carrier means 13, linear drive means 14 and retainer means 15.

Traverse track bridge 11 is provided with an adjustable mount 20 (FIG. 4) to mount traverse track bridge 11 to a wall or other structure over an area to be covered by a drapery. Adjustable mounting structure 20 is shown to include an angle bracket 21 adjustably secured to a telescoping extension support 22 having a clamp 23 secured to support 22 at 24 and adapted with hooking element 25 to be secured over longitudinally extending ribs or flanges 26 of bridge 11. Mount 20 is secured to a wall by screws through openings 27, and telescoping member 22 is adjustably positioned in bracket 21 and retained therein by retaining element 28 common to both the bracket and the extension, through slots 29.

Traverse track bridge 11 includes generally, a first track 30 (FIGS. 1 and 4); a second track 31 (FIGS. 1, 4, 10, 13, 16 and 19); cam means 32 selectively spaced apart and secured at 19 on top surface panel 35 of bridge 11. Traverse track bridge 11 is also provided with a front surface panel 33, a back surface panel 34 and a bottom surface panel 36. First track 30 is provided with an upper track 40 having opposite lower surfaces 41 and 42 and intermediate opposed surfaces 43 and 44. Second track means 31 has upper track edge 45 and lower track edge 46 in rear panel surface 34.

Cam means 32 includes cam trip plate **47*a* secured by 37 at selected adjustable positions 19, along top panel surface 35 of bridge 11 and is provided with a strike surface 48*a*. Cam means 32 also includes cam trip plate 47*b* secured at 38 at selected adjustable positions 19 along top panel surface 35 of bridge 11, and provided with a strike surface 48*b***.

Figures 1, 2, 3:
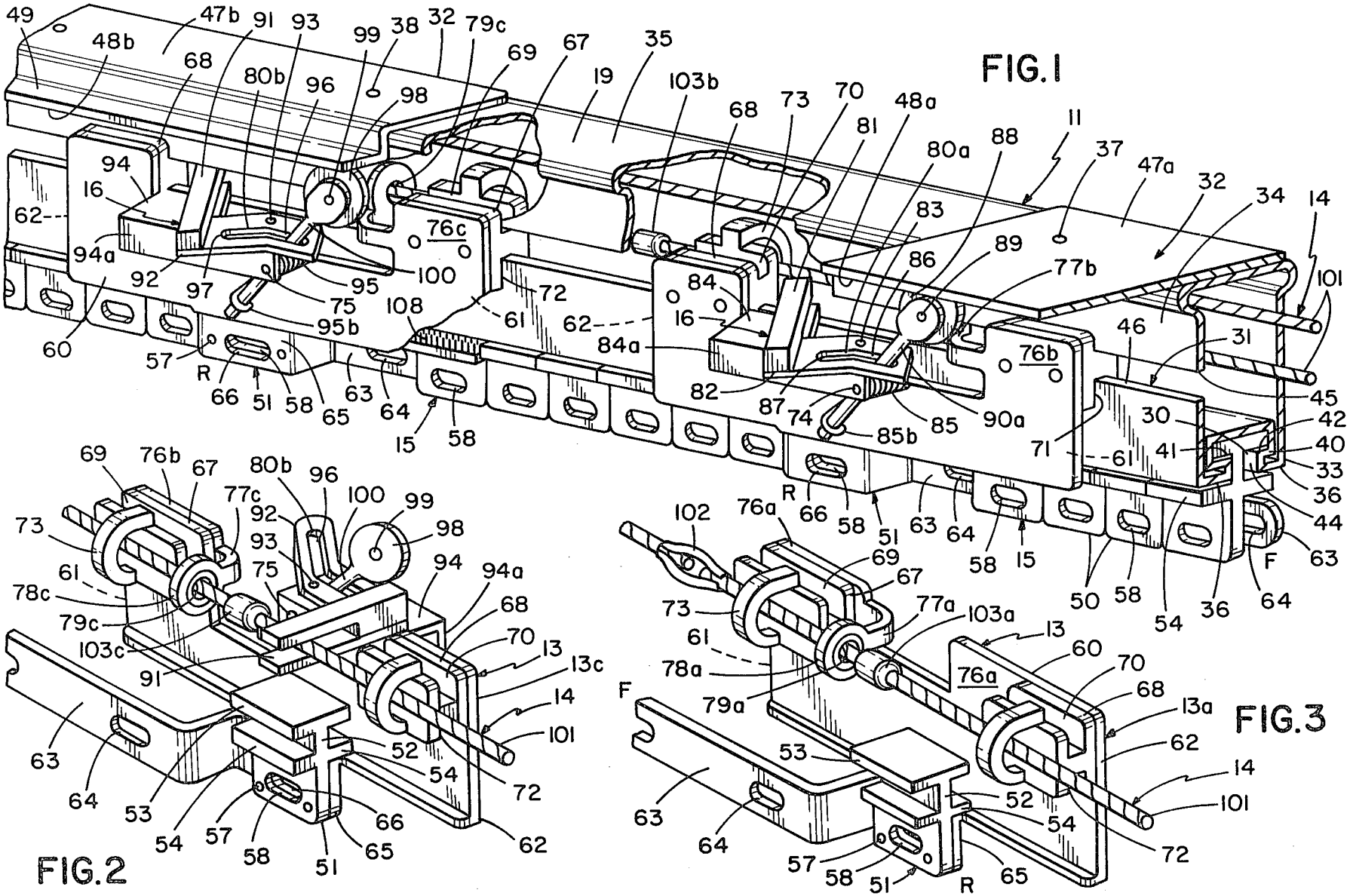
FIG. 1 is a partially cutaway partial perspective view of an improved first embodiment of the drapery hanger and manipulator of this invention showing a traverse track bridge, cam means, drapery hook hanger means, drapery carriers, linear drive means, cam followers, the retainer means, and the mechanical interrelationship of these structures.
FIG. 2 is a perspective view of a drapery carrier of the first improved embodiment of the invention showing the linear drive therethrough and a cam follower pivotally connected thereto, and the drapery carrier drivingly connected with the linear drive means for drive in either direction.
FIG. 3 is a perspective view of an improved drapery carrier of the first embodiment of the invention without the cam follower and connecting structure, illustrating a lead carrier.

It is to be noted that strike surfaces **48*a* and 48*b* extend beyond rear surface panel 34, however, strike surface 48*b* is at a lower offset position 49, as shown in FIG. 1**.

Drapery hook hanger means 12 includes a series of individual drapery hook hangers 50 (FIGS. 1, 4, 7, 8, 10, 11, 13, 14, 16, 17 and 19) interspersed between similar drive transmitting drapery hook hangers 51 and rear hook hanger retainers **107*a* and 107*b*. Hook hangers 50 and 51 have a main vertical body portion 52 with upper oppositely laterally extending stabilizing support runners 53 vertically spaced apart from similar lower runners 54 on said body 52. A drapery support aperture 58 is provided through the lower extension of portion 52 upon which separate respective drapery panels 59*a*, 59*b* and 59*c*** are hung in the usual manner.

Upper runners 53 are provided with lower surface 55 adapted to slidably engage surfaces 41 and 42 of first track 30. Lower stabilizing runners 54 are provided with respective upper surfaces 56 adapted to engage lower surface 36 of first track 30 of bridge 11. Upper and lower runner portions 53 and 54 thereby complementally and respectively engage surfaces 41–42 and 36 to slidably attach hangers 50 and 51 in first track 30 of bridge 11 and to prevent hangers 50 and 51 from turning or otherwise becoming disoriented in sliding attachment with track 30.

Drive transmitting hook hangers 51 differ from individual hook hangers 50 in that drive hangers 51 are attached to respective drapery carriers 13 by rivets 57 or other means of attachment whereby movement of carriers 13 will likewise cause movement of respective drive transmitting hook hangers 51 along track means 30 in serial association with interspaced individual hangers 50.

Drapery carrier means 13 includes three types of carriers **13*a*, 13*b* and 13*c*. Carrier 13*a* is a lead or primary carrier (FIG. 3). Carrier 13*b* is an intermediate follower drapery carrier (FIG. 1) and carrier 13*c* is a secondary follower carrier (FIGS. 1 and 2). Carriers 13*a*, 13*b* and 13*c* are similar in that they are each provided with a carrier frame 60 having a forward end 61, and a reverse end 62. Also, carriers 13***a*, 13*b* and 13*c* each have a drapery supporting bracket 63 extending downwardly with drapery hook support openings 64.

A carrier hook drive bracket 65 is also provided, on carriers 13*a*, 13*b* and 13*c*, extending downwardly therefrom and having a single drapery hook support opening 66 positioned to be aligned with opening 58 of a drive transmitting hook hanger 51 attached thereto by rivets 57 as previously generally referred to. Hook hangers 51 thereby slidably mount carriers 13*a*, 13*b* and 13*c* in first track 30 for movement therealong with drive transmitting brackets 65.

Carrier frames 60 are provided with a pair of track guides 67 and 68 having respective track receiving slots 69 and 70 in the top, track receiving slots 71 and 72 in the bottom, and being respectively positioned adjacent forward and reverse ends 61 and 62 of carrier frame 60. Track guides 67 and 68 are thereby adapted to complementally and slidably support respective carriers 13*a*, 13*b* and 13*c* (FIGS. 1–3).

A cable guide 73 is provided on each track guide 67 and 68 to loosely guide a section of linear drive 14 relative to the carrier of said guides. Carriers 13*a*, 13*b* and 13*c* (FIGS. 1–3, 10, 13, 16 and 19) are also provided with forward drive receiving elements 76*a*, 76*b* and 76*c* respectively and includes right angle drive arms 77*a*, 77*b* and 77*c* extending from adjacent lead guide 67 of respective frames 60. Eyelets 78*a*, 78*b* and 78*c* are provided in each drive receiving structure 76 and have openings 79*a*, 79*b* and 79*c* to accommodate drive 14.

It should be noted that carriers 13*a*, 13*b* and 13*c*, as shown (FIGS. 1–3) are adapted to be positioned on the left rear side of bridge 11 (FIGS. 10, 13, 16 and 19). Carriers 13*a*, 13*b* and 13*c* for the right rear side of the drapery hanger and manipulator of this invention are image structures of the carriers 13*a*, 13*b* and 13*c* as set forth herein for the left side of manipulator 10.

Carrier 13*b* (FIGS. 8–19) is provided with a reverse drive means 16 in the form of a two-pronged fork lock 81 (FIG. 1). Lock 81 is attached to a cam bracket 82 which, in turn, is pivotally mounted by a pin 83 to a cam lock platform 84 extending from carrier frame 60. Cam bracket 82 is also provided with a convex slot 80*a* with apex of convex centered at pivot pin 83 and includes right slot 86 and left slot 87.

A cam follower wheel 88 is rotatably mounted on pin 89 of shift lever 90, which in turn, is positioned in convex slot 80 and pivotally connected at underside of platform 84 by pin 74. Wheel 88 is adapted to engage strike surface 48 of cam trip plate 47 as carrier 13*b* is moved in reverse movement to ends of bridge 16, tripping shift lever 90 clockwise about pin 74 into cam slot 86 to cause cam bracket 82 and reverse drive fork 81 to rotate counterclockwise about pin 83 into an open position (FIG. 1).

A tension spring 85 is interconnected with shift lever 90 by pin 74 through cam lock platform extension 84*a* and carrier frame 60, with one end of spring 85*a* (not shown) positioned under cam lock platform 84, and the other end of spring 85*b* attached to lower end of shift lever 90 to normally bias shift lever 90 counterclockwise into cam slot 87 thus urging cam bracket 82 and reverse drive fork 81 to rotate clockwise into a closed and locked position (FIG. 2).

In regard to this, as carrier 13*b* is moved along bridge 11 to the right, or forward closing direction, until wheel 88 moves free from cam trip plate 47*a*, spring 85 normal bias action will urge shift lever 90 counterclockwise into slot 87 and in turn, cause reverse drive fork 81 and cam bracket 82 to rotate in the clockwise direction about pin 83, locking fork 81, into adjacent position with respect to drive receiving means 14 (FIG. 2).

Similarly, carrier 13*c* (FIGS. 1, 2 and 8–19) is provided with a reverse drive means 16 in the form of a two pronged fork lock 91 (FIGS. 1 and 2). Lock 91 is attached to a cam bracket 92 which, in turn, is pivotally mounted by a pin 93 to a cam lock platform 94 extending from carrier frame 60. A cam follower wheel 98 is rotatably mounted on pin 99 of shift lever 100 which, in turn, is pivotally connected at underside of platform 94 by pin 75. Wheel 98 is adapted to engage cam strike surface 48*b* of offset 49 of cam plate 47*b*, as carrier 13*c* is reversed along bridge 11, tripping shift lever 100 clockwise about pin 75 into cam slot 96 to cause cam bracket 92 and reverse drive fork 91 to rotate counterclockwise about pin 93 into an open position (FIG. 1).

A tension spring 95 is interconnected between shift lever 100 and carrier frame 60 by pin 75 with one end of spring 95*a* (not shown) positioned under cam lock platform 94 and the other end of spring 95*b* attached to lower end of shift lever 100, to normally bias shift lever 100 counterclockwise into cam slot 97 causing bracket 92 and fork 91 to rotate in a clockwise direction thereby locking fork 91 into adjacent position with respect to drive receiving means 14 (FIG. 1).

As previously noted, cam trip plate 47*b* has a lower offset 49 therein in contrast to cam trip plate 47*a* and it is also to be noted that upper portion of trip lever 100 of carrier 13*c* is shorter than upper portion of trip lever 90 of carrier 13*b* (FIG. 1).

In this regard, as carrier 13*c* is moved along bridge 11 to the right, or forward closing direction, fork 91 will remain in the open position until wheel 98 disengages offset surface 48*b* of trip plate 47*b*, the normal bias of spring 95 will trip shift lever 100 counterclockwise into cam slot 97 causing bracket 92 and reverse drive fork 91 to rotate clockwise, thus locking reverse drive 91 into said adjacent position with respect to drive receiving means 14.

It is to be noted, however, that the shorter upper portion of shift lever 100 of carrier 13*c*, will provide unrestrictive clearance for cam follower wheel 99 as said carrier 13*c* passes under higher cam trip plate 47*a*, either in the forward closing directional movement or in the reverse open directional movement of drapery panels.

Linear drive 14 includes two sections of flexible cord or cable 101 (FIGS. 1–3, 9, 10, 12, 13, 15, 16, 18 and 19) having ends joined by clamps or connectors 102 to provide a continuous cable. Clamps 102 have a lateral dimension (FIG. 3) to provide a drive transmitting element for anything closely surrounding cable 101. Further, lateral extending drive projections 103*a*, 103*b* and 103*c* are affixed to cable 101 at spaced-apart intervals therealong to respectively similarly provide a drive transmitting element.

Drive projections 103*a*, 103*b* and 103*c* on the left rear side of a bridge 11 (FIGS. 9, 10, 12, 13, 18 and 19) are respectively progressively larger in a direction to the left, and similarly, drive projections 103*a*, 103*b* and 103*c* on cable 101 on the right rear side of bridge 11 are respectively progressively larger in a direction to the right. Cable 101 is threaded over pulleys 104 (FIG. 13) to direct cable 101 in both directions of movement, at right angles from along bridge 11 to a downward direction (FIGS. 13, 16 and 19), and is further retained rotatably about similar pulleys 105 at opposite sides to allow cable 101 to be moved continuously through the bridge 11 and carriers 13 of this invention and to provide oppositely moving cable sections 101 in bridge 11 as cable 101 is moved over pulleys 104 and 105.

Retainer means 15 (FIGS. 4, 4A, 5, 10, 13, 16, 17 and 19) includes a series of rear drapery hook hanger retainers 107 and differ only from individual hook hangers 50 in that rear hook hanger retainers 107 are provided with spring bristles 108 (FIG. 4) for frictional restraint in track 30. Bristles 108 are incorporated onto the upper surfaces 56 of lower runners 54, with tips of bristles 108, engaging bottom surface panel 36 of track 30 for frictional retainment or smooth displacement therein, along bridge 11. Rear edges 116*a* and 116*b* of drapery panels 59 are secured into apertures 58 of complementary lower extension portions 52 of said retainer means 15.

This invention includes an alternate frictional hook hanger retainer 107*d* (FIG. 4A) which is provided with spring 108*b* mounted on pin 108*a* and over a pair of pins 108*c* and having friction surfaces 108*d* to provide the frictional restraint along track 30.

Figure 4:
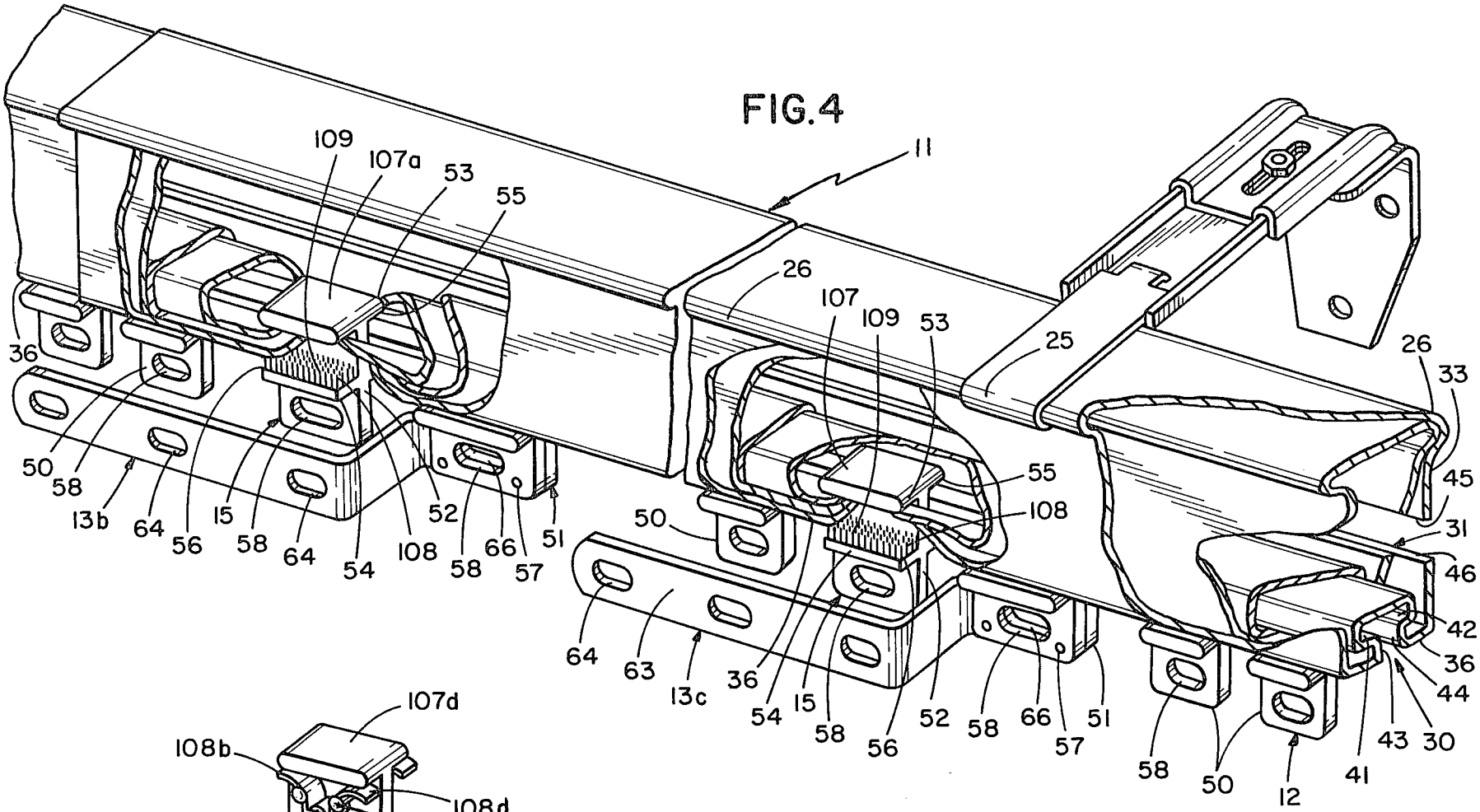
FIG. 4 is a partially cutaway partial perspective view showing the traverse track bridge mounting assembly, bristle frictional retaining means and drapery hook hangers.

It is to be noted here that the rear edges 116*c* of drapery panels 59*c* are secured to ends of bridge 11 in a conventional known manner and the lead edges 115*a*, 115*b* and 115*c* of each drapery panel 59 are secured into openings 64 of carrier 13, support bracket 63 and into adjacent openings 58 of same said carriers' drive transmitting hook hanger 51 (FIGS. 2–4).

Thus, as carriers 13*a*, 13*b* and 13*c* are progressively actuated toward the center of bridge 11, with said lead edges 115*a*, 115*b* and 115*c* of drapery panels 59 attached therein, and with subsequent hook hanger 50 following thereafter, the bristles 108 frictional retainment of rear hook hanger retainers 107*a* and 107*b* against bottom surface panel 39 of track 30 will thereby tend to restrain the rear edges 116*a* and 116*b* of respective drapery panels 59*a* and 59*b*, expanding said panels to their full widths.

This restrainment of rear edges 116*a* and 116*b* of drapery panels 59*a* and 59*b* will cause subsequent lead edges 115*b* and 115*c* of drapery panels in carriers 13*b* and 13*c* to overlap said rear edges 116*a* and 116*b* of drapery panels 59, resulting in complete overlap uniformity in the progressive closing of respective drapery panels 59*a*, 59*b* and 59*c*.

As previously stated, the rear edges 116*c* of drapery panels 59*c* being secured to ends of bridge would cause said drapery panels 59*c* to extend their full width as carriers 13*c* are activated towards the center of bridge 11. Also, lead edges 115*a* of drapery panels 59*a* secured in carriers 13*a* will normally overlap each other at center of bridge for full close as any conventional center close rod.

It is also to be noted that the frictional retainment of rear hook hanger retainers 107*a* and 107*b* will prevent unwanted drifting of rear edges 116 of drapery panels 59, the latter only being displaced from selected positions by movement of carriers 13 through serial engagement of hook hangers 50 which will physically force displacement of said retainers 107*a* and 107*b* towards the ends of bridge 11.

Retainer means 15 of this invention can also be adapted to conventional known types of drapery rods, working likewise, in conjunction with carrier means 13 adaptation, to convert said known drapery systems to operate in similar manner without departing from the principles of the invention.

Figure 4A:
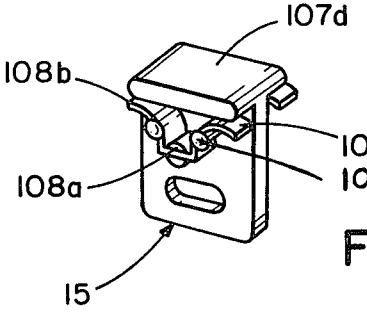
FIG. 4A is a perspective view of an alternate frictional retainer means with special leaf springs as frictional retainment.

FIG. 4A is also a hook hanger retainer incorporating leaf springs to engage bottom surface 36 of track 30 for frictional restrainment thereof.

A second embodiment of the improved drapery hanger and manipulator of this invention is disclosed specifically in FIGS. 5 and 6 and generally in FIGS. 8–20, and is generally illustrated by the numeral 120. Second embodiment 120 includes generally, a traverse track bridge 121, drapery hook hanger means 122, drapery carrier means 123, linear drive means 124 and retainer 125. Traverse track bridge 121 is mounted to support draperies, in any conventional manner.

Traverse track bridge 121 includes, generally, a first track 130 (FIG. 5); a second track 131 (FIG. 5), cam means 132 longitudinally spaced apart on bottom surface panel 133 of bridge 121. Traverse track bridge 121 is also provided with a front surface panel 139, a back surface panel 135, a top surface panel 136, and an upper inner surface 139. First track 130 is provided with a front track 140 having opposite upper surfaces 141 and 142 and lower opposite surfaces 143 and 144. Second track means 131 has forward track edge 145 and rear track edge 146 in panel surface 133.

Cam means 132 includes slots 147 and 147*a* at selected longitudinal positions along panel surface 133 of bridge 121 in rear of second track 131. Drapery hook hanger means 122 includes a series of individual drapery hook hangers 150 as shown in FIGS. 1, 4, 8, 10, 11, 13, 14, 16, 17 and 19, interspersed between frictional hook hanger retainers 187 and similar drive transmitting drapery hook hangers 151. Hook hangers 150, 151 and hook hanger retainers 187*a* and 187*b* have a main vertical body portion 152 with upper oppositely laterally extending stabilizing support runners 153 vertically spaced apart from similar lower runners 154 on body 152. A drapery support aperture 158 is provided through the lower extension of portion 152 (FIGS. 5–7).

Upper runners 153 are provided with lower surface 155 adapted to slidably engage surfaces 141 and 142 of first track 130. Lower stabilizing runners 154 are provided with respective upper surfaces 156 adapted to engage lower surface 143 and 144 of first track 130 of bridge 121. Upper and lower runner portions 153 and 154 thereby complementally and respectively engage surfaces 141, 142, 143 and 144 to slidably attach hangers 150 and 151 in first track 130 of bridge 121 and to prevent hangers 150, 151 and hook hanger retainers 187*a* and 187*b* from turning or otherwise becoming disoriented in sliding attachment with track 130.

Drive transmitting hook hangers 151 differ from individual hook hangers 150 in the same manner as that described above in regard to the first embodiment of this invention, in that drive hangers 151 are attached to respective drapery carriers 123 by rivets 157 or other means of attachment whereby movement of carriers 123 will likewise cause movement of respective drive transmitting hook hangers 151 along track means 130 in serial association with interspaced individual hangers 150, and rear hook hanger retainers 187*a* and 187*b*.

Drapery carrier means 123 includes multiple carriers provided with a carrier frame 160 having a forward end 161 (FIG. 6), and a reverse end 162. Also, carriers 123 have a drapery supporting bracket 163 extending downwardly. A carrier hook drive bracket 165 is also provided, on carriers 123, extending downwardly therefrom and having a single drapery hook support opening positioned to be aligned with respective carrier bracket opening 158. Carrier hook bracket 165 has a drive transmitting hook hanger 151 attached thereto by rivets 157 in a manner as previously generally referred to. Hook hangers 151 thereby slidably mount carriers 123 in frist track 130 for movement therealong with drive transmitting brackets 165.

Carrier frames 160 are provided with a pair of track guides 167 and 168 having respective track receiving slots 169 and 170 toward the back, track receiving slots 171 and 172 toward the front, and being respectively positioned adjacent forward and reverse ends 161 and 162 of carrier frame 160. Track guides 167 and 168 are thereby adapted to complementally and slidably support respective carriers 123 in second track 131 (FIG. 5).

A cable guide opening 173 is provided on each track guide 167 and 168 to loosely guide a section of linear drive 124 relative to respective carriers 123. Carriers 123 are also provided with a forward drive receiving element 176 which includes a right angle drive arm 177 extending from adjacent lead guide 168 of frame 160. Eyelets 178 are provided in each drive receiving structure 176 and have an opening 179 to accommodate drive 124.

It should be noted that carriers 123 are adapted to be positioned on the left rear side of bridge 121. Carriers 123 for the right rear side of the improved drapery hanger and manipulator of this invention are merely image structures of the carriers 123 as set forth herein for the left side of manipulator 120.

Carriers 123 are provided with a reverse drive means in the form of a two-pronged fork lock 181 (FIGS. 5 and 6). Lock 181 is attached to a bracket 182 which, in turn, is pivotally mounted by a pin 183 to a cam lock platform 184 extending from carrier frame 160. Drive receiving fork 181 is normally biased in a counterclockwise direction about pin 183 (FIG. 5) by reason of the greater weight of fork 181 and bracket 182 than a cam follower wheel 188, which is rotatably mounted on a pin 189 on arm 190 connected to bracket 182 adjacent pivot pin 183. Wheel 188 is adapted to normally engage surface 133 of bridge 121 and to enter cam slot 147 as carrier 123 is moved along bridge 121, to allow the normal gravity bias of reverse drive fork 181 to urge fork 181 counterclockwise about pin 183.

It should be noted that the moment arm of link 182 is much longer than arm 190 relative to pivot pin 183 whereby a small amount of movement of the axis of wheel 189 between slot 147 and surface 133 will cause a much greater movement of reverse drive receiving fork 181 (FIG. 5) in the clockwise direction. In this regard, as carrier 113 is moved along bridge 121 to the right, or forward closing direction until wheel 188 moves out of slot 147 and engages surface 133, reverse drive fork 181 and wheel bracket 190 will be caused to rotate in the clockwise direction about pin 183, urging fork 181 into adjacent position with respect to drive receiving means 124.

Retainer means 125 includes a series of rear hook hanger retainers **187*a* and 187*b* and are respectively provided with springs 195 mounted into apertures 191 centered and through surface 159 of a drapery hook hanger 150 stabilizing support runner 153. Shafts 193 are mounted in apertures 196 of said spring 195, and a ball 192, being rotatably encased 194 in upper portion of said shaft 193, is thus seated atop said spring 195 and engages inner upper surface 139 of first track 130 for frictional retainment or smooth displacement therealong bridge 121**.

The functional operation of retainer means 125 is, therefore, like that of retainer means 15 as set forth above for the first embodiment herein.

Linear drive 124 includes a continuous flexible cord or cable 182 (FIGS. 5 and 6) which is constructed, mounted and operated like the linear drive set forth above for the first embodiment herein, and as shown (FIGS. 9, 10, 12, 13, 15, 16, 18 and 19).

As a preliminary basis to the understanding of the operation of this invention, the operation of linear drive 14 (124 for second embodiment) should be considered. In particular, linear drive 14 or 124 is a double section of cables 101 joined by connectors 102. Connectors 102 are of sufficient lateral dimension to comprise a necessary drive aspect of linear drive 14 (FIGS. 9, 12, 15 and 18). In addition to drive elements 102, each section of cable 101 is provided with a series of drive projections **103*a*, 103*b* and 103*c* (FIGS. 1–3 and 8–9) which are selectively spaced along their respective sections of cable 101**.

One section 101 is threaded through guides 73 and eyelets 78 of the left or right series of carriers 13, and the other cable section is threaded through guides 73 and eyelets 78 of the other series of carriers 13 so as to be in controlled proximity therewith and to provide opposite direction drive reaction with eyelets 78 of carrier means 13. This will simultaneously provide opposite direction drive for carriers on the left from those on the right. Thus, the respective series of carriers 13 on the left side of bridge 11 and the right side of bridge 11 will always be driven in opposite directions, either both toward the center of bridge 11 to tend to close the drapes 59, or to the outer ends of bridge 11 to tend to open drapes 59.

Drive elements **103*a*, 103*b* and 103*c* of each series of each side or section of cable 101 are progressively larger in a direction from the center of bridge 11 to pulley 104 and pulley 105. Also, eyelets 78*a*, 78*b* and 78*c* of corresponding carriers 13*a*, 13*b* and 13*c* are similarly larger by respective openings 79*a*, 79*b* and 79*c* thereof whereby when cable 101 of drive 14 is urged through eyelets 78*a*, 78*b* and 78*c* from the edge of bridge 11 toward the center thereof, the smaller drive elements 103*a* will pass through eyelets 78*b* and 78*c* of drive receiving elements 76*b* and 76*c* of corresponding carriers 13*b* and 13*c***.

However, drive elements **103*a* will not pass through eyelet 78*a* of drive element 76*a* of corresponding carrier 13*a* and will thereby tend to urge carrier 13*a* in a direction of linear movement toward the center of bridge 11 by the engagement of drive element 103*a*. Similarly, drive elements 103*b* will pass through eyelet 78*c* of carrier 13*c* without engaging same but will engage eyelet 78*b* of corresponding drive receiving element 76*b* of corresponding carrier 13*b* to drive carrier 13*b* lineally along bridge 11 toward the center thereof. The largest drive element 103*c* will engage respective eyelet 78*c* of drive elements 76*c* of corresponding respective carriers 13*c* whereby linear movement of cable sections 101 toward the center of bridge 11 will similarly urge carriers 13*c* toward the center of bridge 11**.

The operation of the first embodiment of the invention is performed by manipulation of linear drive 14 to either: close the drapes 59 by operating drive 14 in the forward direction to cause carriers 13 to move from adjacent the outer ends of bridge 11 toward the center (FIGS. 8–16); partially intermittently open drapes 59 by partial reverse movement of linear drive 14 from a partially closed condition of the drapes 59, or a fully closed condition of the drapes 59, to selectively provide intermittent partially adjusted opened condition for the drapes 59 (FIGS. 17–19); and open drapes 59 by full reverse movement of linear drive 14 to provide the fully opened condition for drapes 59 (FIGS. 8–10).

Initially, the drapery hanger and manipulator 10 can be considered in the open position (FIGS. 8–10 and 24) with intermittently positioned groups of hook hangers 50 in track and in line with interpositioned series of carriers 13*a*, 13*b* and 13*c* stacked or otherwise positioned adjacent the outer ends of bridge 11 (FIG. 10). In this initial position, driving elements 103*b* and 103*c* of linear drive 14 are withdrawn from within bridge 11, and lead drive elements 103*a* and center drive elements 102 (FIG. 9) of opposite midpoints of linear drive 14, are within bridge 11.

Linear drive 14 is thereupon actuated by manually urging inner vertical cable portion, of respective extending cables 101, downwardly (FIG. 10) causing the outer vertical portion of cable sections 101 to move upwardly and over respectively pulleys 104 into bridge 11 (FIGS. 8–10). As cable sections 101 are thus moved in bridge 11, central drive elements 102 will each move toward the center of bridge 11 and the immediately adjacent next drive element 103*a* will engage its respective drive receiving eyelet 78*a* of drive element 76*a* of corresponding carrier 13*a* (FIGS. 3 and 9) to urge carrier 13*a* toward the center of bridge 11 tending to close the inner drape section 59*a* toward the middle (FIGS. 11–13).

Continued movement of cable sections 101 of linear drive 14 into bridge 11 (FIGS. 11–13) will continue this movement of carriers 13*a* toward the center of bridge 11 until the next larger driver 103*b* engages its correspondingly next larger size drive receiving eyelet 78*b* of its corresponding carrier 13*b* to urge carrier 13*b* similarly toward the center of bridge 11 tending to close the next respective drape section 59*b* (FIGS. 11–16).

Further, continued movement of cable sections 101 of linear drive 14 will urge the third and progressively largest drive element 103*a* (FIGS. 14–16) into bridge 11 toward the center thereof and into eventual engagement with its corresponding eyelet 78*c* of drive receiving element 76*c* of corresponding carrier 13*c* to similarly urge carrier 13*c* toward the center of bridge 11. Continued final movement of cable 101 of linear drive 14 to urge carriers 13*a*, 13*b* and 13*c* from opposite sides of bridge 11 until carriers 13*a* engage in the center of bridge 11 (FIGS. 1–16).

As carriers 13*a*, 13*b* and 13*c* are moved from the edge of bridge 11 toward the center as above described, and as progressively larger drive elements 103*a*, 103*b* and 103*c* progressively engage their corresponding respective eyelets 78*a*, 78*b* and 78*c* of respective corresponding carriers 13*a*, 13*b* and 13*c* to urge same toward the center, reverse drive receiving means of linear drive 14 are also being progressively actuated. In particular, as carriers 13*a*, 13*b* and 13*c* are moved from the end toward the center of bridge 11, respective cam follower wheels 88 and 98 of cam means 32 and carriers 13*b* and 13*c* are respectively and selectively released from cam surfaces 48*a* and 48*b* which are selectively positioned along top surface 35 of bridge 11.

As carriers 13*b* and 13*c* are moved from the ends to the center of bridge 11, cam means 32 is thus actuated by the disengagement of wheels 88 or 98 from cam trip plate surfaces 48*a* and 48*b* to cause forks 81 and 91 to be urged into surrounding position with respect to linear drive cable 101 (FIGS. 2, 9, 12, 15 and 18) whereby respective drive elements 103*b* and 103*c* are retained between corresponding carrier eyelets 78*b* and 78*c* and corresponding reverse drive retaining forks 81 or 91. In this condition, movement in either direction of cable 101 of linear drive 14 will cause corresponding movement of carriers 13*b* or 13*c* by virtue of respective forks 81 or 91 being positioned in proximity with cable 101 of linear drive 14 and the drivers 103*a*, 103*b* and/or 103*c*.

Thus, movement in either direction will then urge the carriers correspondingly until a given carrier 13*b* or 13*c* is moved in the reverse direction to a point where respective cam wheel 88 or 98 will be tripped by cam trip plates 47*a* and 47*b* respectively; at which time, forks 81 and 91 will be respectively and selectively removed from driving relationship with linear drive 14, by pivoting away from cable 101 about pins 83 or 93, to allow continued movement of the corresponding carriers 13 to remove the drapes toward the ends of bridge 11.

As linear drive 14 is manipulated to move carriers 13*a* from the ends of bridge 11 toward the center thereof, carriers 13*b* and 13*c* are eventually picked up by the drive elements and moved across the opening to close the drapes in accordance with movement of linear drive 14. However, reverse movement of linear drive 14 does not similarly reverse the movement of carriers 13*b* and 13*c* in view of the above-described selectivity of the reverse drive mechanism.

In particular, when the sections of the cable 101 are moved in opposite directions away from the center of bridge 11 toward the ends thereof, drive elements 103*b* and 103*c* of each series of carriers 13*a*, 13*b* and 13*c* will initially be urged toward the respective ends of bridge 11 by virtue of reverse drive forks 81 and 91 of corresponding carriers 13*b* and 13*c*. Substantially simultaneously, drive respective elements 102 will similarly urge respective carrier 13*a* in the reverse direction respectively toward the ends of bridge 11.

In the interim, the above carriers 13 and drapery 59, movements toward and engagement at center of bridge 11, will likewise cause the progressive movement of hook hangers 50 and hook hanger retainers 107*a* and 107*b* to follow and be selectively positioned and retained along bridge 11, as previously described above in detail.

Thus, by the above reverse action, the lead edges 115*a*, 115*b* and 115*c* of respective corresponding drapery panels 59*a*, 59*b* and 59*c* of each series, will also be urged from their serial positions toward ends of bridge 11 by corresponding respective carriers 13*a*, and 13*b* and 13*c*, causing drapery panels 59*a*, 59*b* and 59*c* of each series to collapse initially, without disturbing the retention position of the rear drapery edges 116*a* and 116*b*, created by the hook hanger retainers 107*a* and 107*b* frictional bristles 108 against bottom surface panel 36. This intermittent collapse will create the corresponding opening between each drapery panel 59 from the center to the ends of bridge 11 (FIGS. 17–19) and thereby create the desired intermittent drapery effect (FIG. 23).

Under these circumstances, continued movement of respective drive cables 101, in the direction from the center of bridge 11 toward the end thereof, will cause carriers 13*a*, 13*b* and 13*c* of each series of carriers 13*a*, 13*b* and 13*c* to serially stack along bridge 11 with carrier hooks 50 intersperced and thus force the rear hook hanger retainers 107*a* and 107*b* from respective corresponding positions allowing all drape sections 59*a*, 59*b* and 59c to be moved completely to the right or open position (FIGS. 8–10 and 24).

As cable 101 is urged in the opposite or reverse direction, from the center toward the ends of bridge 11, drive elements 103b and 103c are normally able to pass out of bridge 11 and downwardly toward pulley 105 (FIG. 10) as released by carriers' 13b or 13c cam means 32.

Thus, it can be seen that the improved structure of this invention provides a drapery curtain manipulator and corresponding apparatus which provides for the manipulation of separate panels of drapes 59 whereby the drapery panels 59 can be urged to a completely closed position; to an interspaced or intermittent open position with selectivity; and to a completely opened position by a single linear drive being selectively and controllably urged in either direction.

This same structure further allows for many variations that are not otherwise accomplishable by drapery hangers presently known. Also, it should be noted that individual panels such as 59a, 59b and 59c can be tied together in varying patterns to create drapery hanger patterns such as indicated (FIGS. 20, 21 and 22), and yet be manipulatable to a fully closed position; selectively intermittent or interspaced adjustable position; or to a fully open position (FIG. 24).

The operation of the second embodiment of the improved drapery hanger and manipulator of this invention is substantially identical with that above set forth with respect to the first embodiment hereof. Carriers such as 123 (FIG. 5) are substituted for carriers 13 and horizontally positioned track of bridge 121 are substituted to contain the movement of carriers 123 and the corresponding linear drive 124.

It is to be understood that the invention is not to be limited to the specific constructions and arrangements shown and described, as it will be understood to those skilled in the art that certain changes may be made without departing from the principles of the invention.

What is claimed is:

1. An improved drapery hanger and manipulator for supportably hanging and manipulating one or more drapery curtain panels having a leading and a trailing edge comprising a traverse track bridge to be positioned over an area to be covered by drapery, said bridge having a first track means therealong to slidably support a drapery hook hanger means, said bridge having a second track means therealong to slidably support a drapery carrier means, said bridge having cam means longitudinally spaced apart therealong, drapery hook hanger means slidably supported in said first bridge track for supporting drapery hooks slidably movable along said bridge to support the drapery panels from the leading to the trailing edge thereof, drapery carriers serially slidably supported in said second bridge track for independent movement along said bridge, said carriers having a hook extension connected to respective selected ones of said series of hook hangers to cause said selected hook hangers to respectively move with said carriers, a linear drive means having forward and reverse drive means for selectively providing forward and reverse linear drive along said bridge, said carriers having forward drive receiving means adapted to sequentially receive forward drive from said linear drive means for respectively moving said panels by urging the leading edge along said bridge in a direction away from the trailing edge thereof, said carriers having reverse drive receiving means disconnectably and respectively receiving said reverse drive means to normally respectively drive said carriers in a reverse direction along said bridge for respectively moving said panels by urging the leading edge along said bridge in a direction toward the trailing edge thereof for collapsing said panels, a cam follower on one or more of said carriers and responsive to said cam means as said carriers are moved in reverse along said bridge for disconnecting respective reverse drive receiving means to selectively and respectively disconnect the reverse movement of said carriers from said linear drive means, and retainer means longitudinally spaced apart on said bridge respectively and progressively in the linear path of said drapery hook hanger means frictionally supporting and normally retaining and positioning the respective panel trailing edges along said first track to correspondingly retain and position said hook hanger means in groups along said bridge as said carriers are moved along said bridge, whereby said carriers can be driven in the forward direction by said forward drive means to sequentially position drapery curtain panels over a given drapery area, and in the reverse direction by said reverse drive means toward and against the frictional retention and position to individually respectively collapse said panels toward said frictionally positioned retainers or to withdraw said panels from the given area by continuous reverse movement to provide respective separate light openings for each panel or to selectively completely remove or collapse said panels from the given area.

2. An improved drapery hanger and manipulator as defined in claim 1 wherein said first traverse bridge track means comprises a T-slot extending longitudinally along the bottom of said bridge, and a bottom surface longitudinally parallel with said slot, and said drapery hook hanger means comprises individual hook hangers having a T-shaped upper portion and lateral side projections in respective complemental sliding relationship with said T-slot and said bottom surface, and a downwardly extending lower portion adapted to accept and retain drapery hooks for supporting draperies.

3. An improved drapery hanger and manipulator as defined in claim 1 wherein said second traverse bridge track means comprises a key slot extending longitudinally along a side of said bridge, and said drapery carriers being adapted to be slidably keyed into said key slot.

4. An improved drapery hanger and manipulator as defined in claim 2 wherein said second traverse bridge track means comprises a key slot extending longitudinally along a side of said bridge, and said drapery carriers being adapted to be slidably keyed into said key slot.

5. An improved drapery hanger and manipulator as defined in claim 1 wherein said traverse track bridge comprises multiple complementally telescoping sections with said first and second track means continuous therethrough.

6. An improved drapery hanger and manipulator as defined in claim 1 wherein said linear drive means comprises a continuous loop of line axially movably mounted to said bridge with two sections thereof positioned to move parallelly and longitudinally within said bridge in opposite directions, and said forward and reverse drive means being a series of annular lateral projections for each line section, and said annular lateral projections of each series being progressively larger in the forward movement direction of said line and being selectively spaced apart along said section.

7. An improved drapery hanger and manipulator as defined in claim 1 wherein said carrier forward drive receiving means comprises a drive projection located on each of said carriers in the path of said forward drive means and having respectively progressively smaller openings therethrough in the forward direction of movement whereby forward movement of said line through said openings will cause said progressively larger annular projections to sequentially and respectively engage said drive projections at the openings thereof to similarly sequentially and respectively drive said carriers.

8. An improved drapery hanger and manipulator as defined in claim 5 wherein said carrier forward drive receiving means comprises a drive projection located on each of said carriers in the path of said forward drive means and having respectively progressively smaller openings therethrough in the forward direction of movement whereby forward movement of said line through said openings will cause said progressively larger annular projections to sequentially and respectively engage said drive projections at the openings thereof to similarly sequentially and respectively drive said carriers.

9. An improved drapery hanger and manipulator as defined in claim 1 wherein said carrier reverse drive receiving means comprises a series of forked projections respectively pivotally mounted on said carriers to be pivotally movable to position the tines thereof into the path of said annular lateral line projections, said forked projections being normally biased into said engagement with said annular line projections.

10. An improved drapery hanger and manipulator as defined in claim 5 wherein said carrier reverse drive receiving means comprises a series of forked projections respectively pivotally mounted on said carriers to be pivotally movable to position the tines thereof into the path of said annular lateral line projections, said forked projections being normally biased into said engagement with said annular line projections.

11. An improved drapery hanger and manipulator as defined in claim 1 wherein said second traverse bridge track means comprises a key slot extending longitudinally along a side of said bridge, and said drapery carriers being adapted to be slidably keyed into said key slot, said linear drive means comprises a continuous loop of line axially movably mounted to said bridge with two sections thereof positioned to move parallelly and longitudinally within said bridge in opposite directions, and said forward and reverse drive means being a series of annular lateral projections for each line section, and said annular lateral projections of each series being progressively larger in the forward movement direction of said line and being spaced apart along said second, said carrier reverse drive receiving means comprises a series of forked projections respectively pivotally mounted on said carriers to be pivotally movable to position the tines thereof into the path of said annular lateral line projections, and said forked projections being normally biased into said engagement with said annular line projections.

* * * * *